US006967270B2

(12) United States Patent
Gerardi et al.

(10) Patent No.: US 6,967,270 B2
(45) Date of Patent: Nov. 22, 2005

(54) STRUMMABLE ELECTRIC HARPSICHORD

(76) Inventors: Michael M. Gerardi, 28876 Woodcrest Lake Dr., Menifee, CA (US) 92584; Gregory A. L Piccionelli, 30801 Calaise Ct., Westlake Village, CA (US) 91362

( * ) Notice: Subject to any disclaimer, the term of this patent is extended or adjusted under 35 U.S.C. 154(b) by 59 days.

(21) Appl. No.: 10/669,092

(22) Filed: Sep. 23, 2003

(65) Prior Publication Data

US 2004/0149118 A1 Aug. 5, 2004

Related U.S. Application Data

(60) Provisional application No. 60/413,497, filed on Sep. 24, 2002.

(51) Int. Cl.[7] ..... G10D 1/22
(52) U.S. Cl. ..... 84/285
(58) Field of Search ..... 84/7–9, 263, 285

(56) References Cited

U.S. PATENT DOCUMENTS

| | | | | | |
|---|---|---|---|---|---|
| 1,828,315 | A | * | 10/1931 | Cavicchioli | 84/263 |
| 1,895,383 | A | * | 1/1933 | Sullivan | 84/263 |
| 4,037,503 | A | * | 7/1977 | Jacobson et al. | 84/9 |
| 4,377,101 | A | * | 3/1983 | Santucci | 84/743 |
| 4,483,233 | A | * | 11/1984 | Benson | 84/263 |
| 5,212,330 | A | * | 5/1993 | Cooper | 84/320 |
| 5,380,948 | A | * | 1/1995 | Freimuth et al. | 84/8 |
| 6,166,307 | A | * | 12/2000 | Caulkins et al. | 84/50 |
| 6,723,904 | B1 | * | 4/2004 | Dolan et al. | 84/267 |

* cited by examiner

*Primary Examiner*—Jeffrey Donels

(57) ABSTRACT

A musical instrument includes a plurality of strings and a plurality of pluckers. The strings are tuned in an ascending sequence, such as a chromatic sequence. The pluckers are associated with a different one of the plurality of strings and are adapted to pluck the string at a range of plucking frequencies. Control means enable selective control of the frequency with which the pluckers pluck the strings.

33 Claims, 10 Drawing Sheets

STRUMMABLE ELECTRIC HARPSICHORD

This application is based on U.S. Provisional Patent Application Ser. No. 60/413,497, filed Sep. 24, 2002, to Michael M. Gerardi and Gregory A. Piccionelli, the disclosure of which is incorporated in its entirety herein by reference.

FILED OF THE INVENTION

The present invention relates to musical instruments, in particular keyboard instruments of the harpsichord type.

BACKGROUND OF THE INVENTION

Musical instruments comprising a plurality of strings and a keyboard have been known for centuries. Keyboard instruments of the piano type include a plurality of hammers, each hammer associated with one key and one string. When a piano key is depressed, an activating mechanism causes the associated hammer to strike the appropriate string, producing a musical tone. Keyboard instruments of the harpsichord type, in contrast, include a plurality of plucking elements, each of which is likewise associated with one key and its corresponding string. When a harpsichord key is depressed, an activating mechanism causes the associated plucking element to pluck the appropriate string, producing a musical tone.

Most known keyboard instruments, however, rely on acoustic mechanisms to produce musical tones. Furthermore, the kinds of chords, as well as the rhythms and tempi that can be realized, are limited by the skill of the performer as well as by anatomical constraints due to the flexibility and reach of the performer's hands.

A need exists for a keyboard instrument which is capable of producing musical tones in non-traditional manners.

A need also exists for a keyboard instrument which enables a performer to produce novel chords, rhythms and tempi.

SUMMARY OF THE PREFERRED EMBODIMENTS

In accordance with one aspect of the present invention, there is provided a musical instrument that includes a plurality of strings and a plurality of pluckers. The strings are tuned in an ascending sequence (for example, a chromatic sequence). The pluckers are associated with a different one of the plurality of strings and are adapted to pluck the string at a range of plucking frequencies. The inventive instrument further includes control means for selectably controlling the frequency with which the pluckers pluck the strings.

In one more specific embodiment, the plurality of strings comprise metal strings, and more specifically a first plurality of electric bass guitar strings and a second plurality of electric guitar strings. According to a particular embodiment, the first plurality of electric bass guitar strings includes at least one string having an open-string tuning of E, at least one string having an open-string tuning of A, at least one string having an open-string tuning of D, and at least one string having an open-string tuning of G, and the second plurality of electric guitar strings includes at least one string having an open-string tuning of E, at least one string having an open-string tuning of A, at least one string having an open-string tuning of D, at least one string having an open-string tuning of G, at least one string having an open-string tuning of B, and at least one string having an open-string tuning of E (the octaves of the first and sixth electric guitar strings being different). That is, specific embodiments of the inventive instrument include at least one of each string of an electric bass guitar and an electric guitar.

Additional more specific embodiments of the inventive instrument include a baseboard having a first plurality of frets corresponding to the frets of an electric base guitar and a second plurality of frets corresponding to the frets of an electric guitar. Preferably the frets corresponding to electric bass guitar frets extend across the baseboard such that they span the first plurality of electric bass guitar strings, and the frets corresponding to electric guitar frets extend across the baseboard such that they span the second plurality of electric guitar strings. This embodiment allows the pitch of each of the plurality of electric bass guitar strings and electric guitar strings to be set by contacting the string with a corresponding fret. In more particular embodiments, the entire chromatic sequence between the open E string of an electric bass guitar and the twenty-second fret of the second E string of an electric guitar is provided, enabling the user to play any note or chord playable on a conventional electric bass guitar or electric guitar.

Analogous embodiments using other types of strings and other arrangements of frets enable a user to play any note or chord playable on other conventional stringed instruments such as acoustic guitars, steel guitars, mandolins, lutes, banjos, sitars, balalaikas, ukuleles and the like.

According to specific embodiments of the invention, the pluckers include a actuator and a plectrum. The plectrum is activated by the actuator and plucks its associated string. The actuator, in more specific embodiments, is an electromechanical device such as a solenoid.

The control means, in specific embodiments, include a first processor that provides an activating signal to the pluckers, and a selector having a plurality of positions each corresponding to a different plucking frequency. In particular embodiments, the selector is a device such as pedal, a dial, or a slider, which allow for a continuous range of plucking frequencies, or a device such as a switch having a plurality of discrete positions, which afford a set of discrete plucking frequencies. In further more specific embodiments, two or more separate selectors are employed, with each selector being used to specify the plucking frequency with respect to a different portion of the plurality of strings. For example, one selector can be employed to select the plucking frequency used with electric bass guitar strings while a second selector can be similarly employed for electric guitar strings.

According to more specific embodiments, the first processor of the control means provides an output that is specified by the position of the selector and that causes the plucker to pluck its associated string at a frequency specified at least in part by this position when the plucker is activated. Particular embodiments further include means for enabling a user to specify the plucking frequency corresponding to one or more positions of the selector.

Particular embodiments of the inventive instrument are acoustic in nature, and thus further include a sounding box within which the plurality of strings is mounted. Other particular embodiments of the inventive instrument are electric in nature, preferably including metal strings such as electric guitar and/or electric bass guitar strings. More particular embodiments thus include a plurality of pick-ups. In such embodiments, each of the plurality of strings is associated with at least one of the plurality of pick-ups, and each of the plurality of pick-ups is responsive to at least one of the plurality of strings. In other more specific embodiments, the inventive instrument also includes means for electrical communication between the plurality of pick-ups and an external amplifier. In other more specific embodiments, the inventive instrument includes an amplifier in electrical communication with the plurality of pick-ups.

Additional particular embodiments of the invention include means for activating the pluckers. Exemplary specific means include a plurality of keys, with each of the plurality of pluckers being activated by at least one of the keys. According to more specific embodiments, the plurality of keys includes a first plurality of keys arranged in a keyboard. Each of the first plurality of keys activates a plucker corresponding to one of the plurality of strings.

In alternative particular embodiments, at least a portion of the first plurality of keys activates two pluckers. The pluckers so activated correspond to strings differing in pitch by a predetermined tonic interval, such as an octave, a fifth, etc. More specific embodiments further include means for selectively specifying this predetermined tonic interval. Two or more portions of the first plurality of keys can also activate pairs of pluckers separated by different tonic intervals, in alternative more particular embodiments.

According to further alternative embodiments, the inventive instrument includes a second plurality of keys each of which simultaneously activates a plurality of pluckers. Such embodiments enable the user to play, for example, preselected chords by playing one or more of such keys. In more particular embodiments, the instrument further includes means for selectively controlling the frequency at which each of the plurality of simultaneously activated pluckers plucks the string associated therewith. Such embodiments enable "partial strumming" in which one or more notes of a chord are plucked repeatedly at a desired frequency while the remaining notes of the chord are sounded a single time. Such embodiments further enable "polyrhythmic strumming, " in which two or more notes of a chord are strummed at different frequencies.

According to still other particular embodiments, the inventive instrument further includes a second plurality of strings tuned in an ascending sequence, a second plurality of pluckers, with each of the pluckers being associated with a different one of the second plurality of strings and being adapted to pluck the string at a range of frequencies, and control means for selectably controlling the frequency with which the second pluckers pluck the second strings. In more particular embodiments, the second plurality of strings include strings formed from materials different from the materials used informing the corresponding strings of the first plurality of strings. In such embodiments, the user can alternate between the two sets of strings, or can simultaneously activate both sets of strings for novel musical effects. In very specific embodiments, separate keyboards can be used for each of the two pluralities of strings.

According to still other particular embodiments, the inventive instrument further includes a second plurality of strings tuned in an ascending sequence, a plurality of hammers, each of the hammers being associated with a different one of the second plurality of strings, and means for activating each of the plurality of hammers to strike the string of the second plurality of strings associated therewith. Such embodiments enable the user to alternate between "harpsichord" and "piano" modes, or alternatively to activate both modes simultaneously to achieve novel musical effects.

Yet other particular embodiments of the inventive instrument include means for producing at least one sound effect, more particularly effects such reverb, fuzz, wah-wah and/or damping. Still other particular embodiments of the inventive instrument include means for selectively specifying the volume of the tone produced by at least one plucked string.

Additional particular embodiments of the inventive instrument further include a capo bar adapted to extend across at least a portion of the plurality of strings. Such embodiments enable the user to change the key of at least a portion of the plurality of strings.

Yet other specific embodiments of the inventive instrument further include programmable means for sequentially activating a plurality of the pluckers. Such embodiments allow the user to program entire musical compositions to be played automatically by the instrument.

Other objects, features and advantages of the present invention will become apparent to those skilled in the art from the following detailed description. It is to be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The invention may be more readily understood by referring to the accompanying drawings in which.

Like numerals refer to like parts throughout the several views of the drawings.

DETAILED DESCRIPTION OF THE PREFERRED EMBODIMENTS

Figure 1:
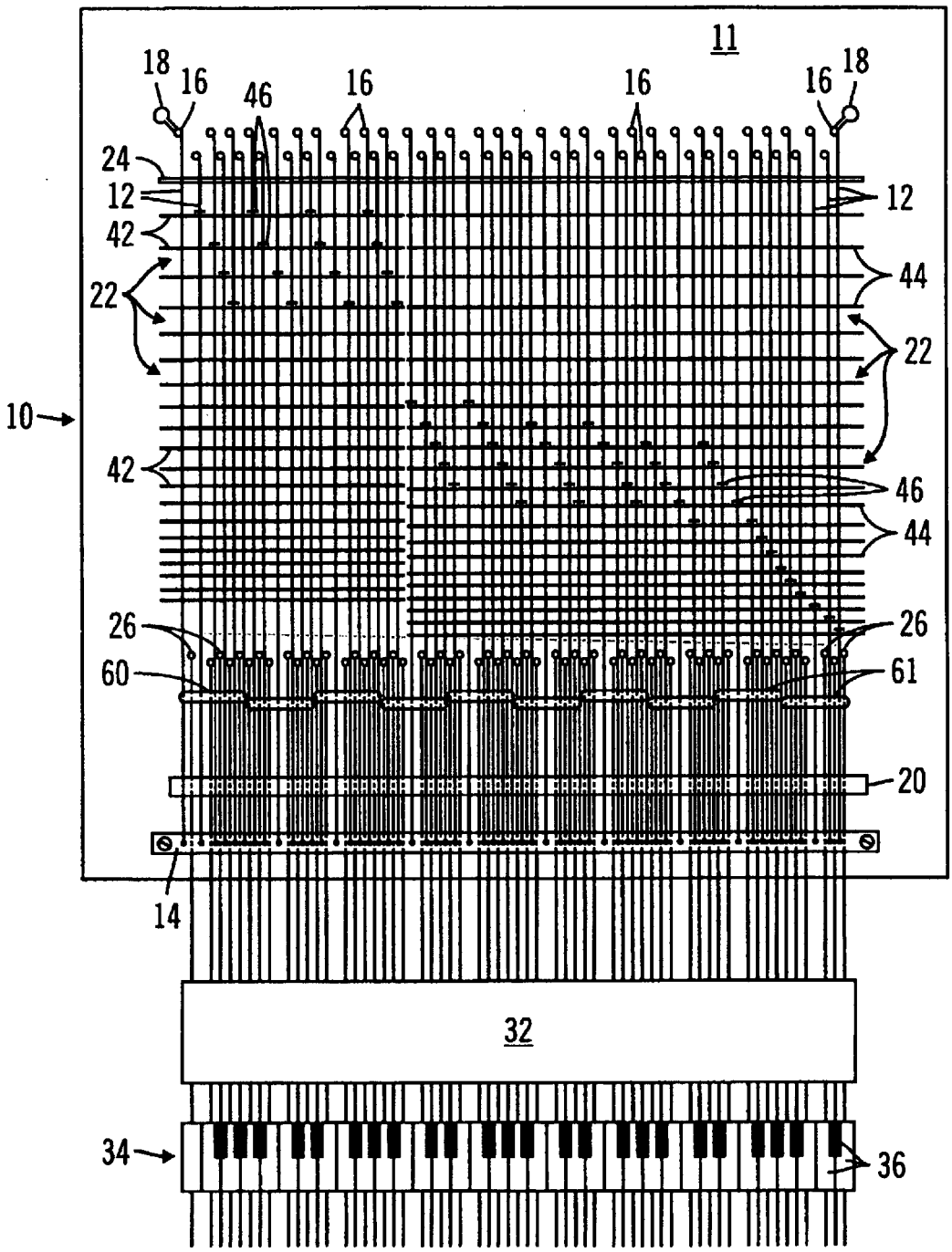
FIG. 1 is a schematic diagram illustrating a first embodiment of a musical instrument according to the invention which includes a keyboard, showing the relationships between the keys of the keyboard and the various strings, as well as the placement of pluckers, pick-ups, processor, backboard and frets.
Figure 2:
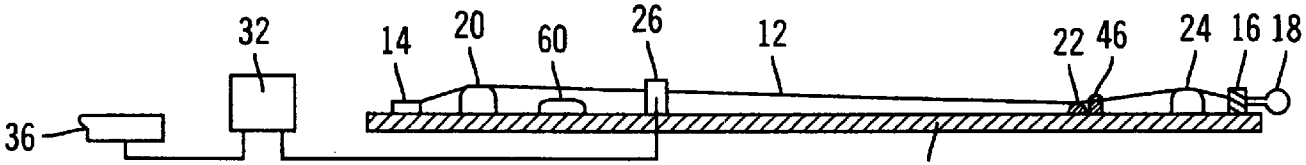
FIG. 2 is a detailed schematic diagram of a string, key, processor and plucker useful in embodiments of the invention.
Figure 3E:
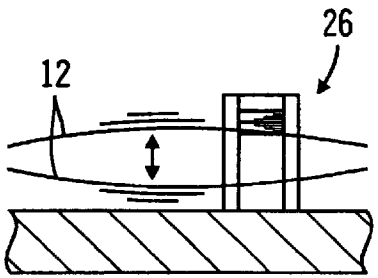
FIGS. 3A–F are side and end views showing a plucker before, during and after it plucks its associated string.
Figure 3C:
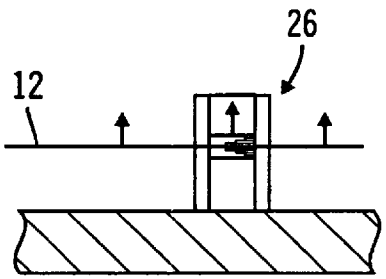
Figure 3A:
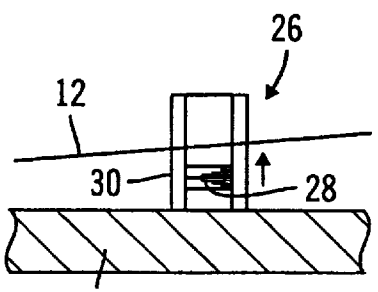
Figure 3F:
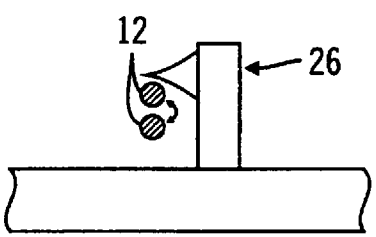
Figure 3D:
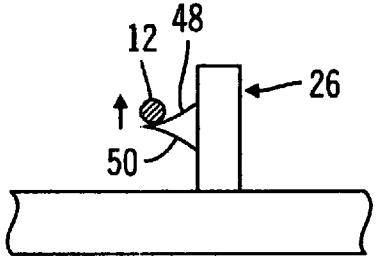
Figure 3B:
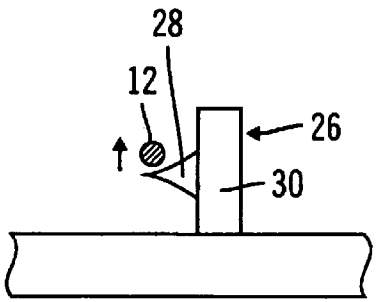

Turning to FIGS. 1 and 2, first embodiment 10 of a musical instrument according to the present invention includes a baseboard 11 and a plurality of strings 12, each secured at a first end to a tailpiece 14 secured to baseboard 11 and at a second end to a string post 16 of a tuning head 18, also secured to baseboard 11, and passing over a bridge 20, a plurality of frets 22 and a nut 24 secured to baseboard 11.

As illustrated, the baseboard, strings and other elements are oriented vertically. However, other orientations of these elements will be readily apparent to the skilled artisan, and all are considered part of the invention.

Associated with each string 12 is a plucker 26 secured to baseboard 11, which in the illustrated embodiment includes a plectrum 28 secured to an actuator 30.

Each actuators 30 of each plucker 26 is in electrical communication with a processor 32. As illustrated, one processor 32 is in electrical communication with all of the pluckers 26. However, if desired two or more separate processors can be employed. For example, a separate processor can be associated with each plucker 26.

Processor 32 provides an activating signal to plucker 26 in response to an input supplied by a user. In the embodiment of FIG. 1, instrument 10 includes a keyboard 34 comprising a plurality of keys 36, each key of which is associated with a different plucker 26, and hence with a different string 12. When a key 36 is struck by a user, a signal is provided to processor 32, causing processor 32 in turn to provide an activating signal to plucker 26. Actuator 30 of plucker 26 then causes plectrum 28 of the plucker to move into contact with and subsequently pluck its associated string 12, producing a musical note.

Strings 12 can be comprised of any desired material, such as gut, metal, etc. More specific embodiments include one or more strings comprised of metal. As illustrated, instrument 10 includes a first plurality 38 of electric bass guitar strings and a second plurality 40 of electric guitar strings.

Particular embodiments including electric bass guitar and electric guitar strings utilize at least one of each of the following strings: electric bass strings having open string tunings of E, A, D and G; electric guitar strings having open string tunings of E, A, D, G, B and E (the two E strings, as usual, corresponding to different octaves). Each string is tuned to the desired note within the selected ascending sequence (as described further below). In more particular embodiments the selected ascending sequence is a chromatic sequence, for example the chromatic sequence between the open E string of an electric bass guitar and the twenty-second fret of the second E string of an electric guitar (the "full chromatic sequence"). Other sequences can be used as desired, for example sequences corresponding to various major and minor scales, synthetic scales such as whole tone scales, diminished scales and pentatonic scales, and the like.

Various combinations of the chosen strings, such as electric bass guitar E, A, D and G strings and electric guitar E, A, D, G, B and E strings, can be used to span the selected ascending sequence. Exemplary embodiments spanning the full chromatic sequence are given below. Indicated frets are the appropriate electric bass guitar or electric guitar frets:

| String | Number Used | Range |
|---|---|---|
| Electric Bass Guitar E | 5 | E (open)–G# (fret 4) |
| Electric Bass Guitar A | 5 | A (open)–C# (fret 4) |
| Electric Bass Guitar D | 5 | D (open)–F# (fret 4) |
| Electric Bass Guitar G | 5 | G (open)–B below middle C (fret 4) |
| Electric Guitar E | 5 | Middle C (fret 8)–E (fret 12) |
| Electric Guitar A | 6 | F (fret 8)–A# (fret 13) |
| Electric Guitar D | 5 | B (fret 9)–D# (fret 13) |
| Electric Guitar G | 5 | E (fret 9)–G# (fret 13) |
| Electric Guitar B | 5 | A (fret 10)–C# (fret 14) |
| Electric Guitar E | 13 | D (fret 10)–D (fret 22) |
| Electric Bass Guitar E | 5 | E (open)–G# (fret 4) |
| Electric Bass Guitar A | 5 | A (open)–C# (fret 4) |
| Electric Bass Guitar D | 5 | D (open)–F# (fret 4) |
| Electric Bass Guitar G | 5 | G (open)–B below middle C (fret 4) |
| Electric Guitar E | 7 | Middle C (fret 8)–F# (fret 14) |
| Electric Guitar A | 7 | G (fret 10)–C# (fret 16) |
| Electric Guitar D | 7 | D (fret 12)–G# (fret 18) |
| Electric Guitar G | 7 | A (fret 14)–D# (fret 20) |
| Electric Guitar B | 5 | E (fret 17)–G# (fret 21) |
| Electric Guitar E | 6 | A (fret 17)–D (fret 22) |

Other string combinations will be readily apparent to those skilled in the art for the full chromatic sequence and for any desired subsequence.

Similarly, various combinations of strings used in other stringed instruments, such as mandolins, lutes, banjos, sitars, ukuleles, balalaikas, can be used in any desired ascending sequence and will be readily apparent to those skilled in the art. Strings used with two or more different types of instruments can also be used. For example, lute strings can be used for bass clef notes while mandolin strings are used for treble clef notes. All such combinations of strings are contemplated to be encompassed by the present invention.

The pitch of each selected string can be set in various ways. For example, in those embodiments using electric bass guitar and electric guitar strings, a first plurality 42 of frets corresponding to the frets of an electric bass guitar and a second plurality of frets 44 corresponding to the frets of an electric guitar can be secured to baseboad 11. Each string is brought into contact with the appropriate fret to produce the desired tone, for example by use of a clip 46. In alternative embodiments, the positions of the various frets on the backboard are variable, thus allowing the strings to be tuned to any desired ascending sequence, such as sequences that include quartertones and smaller microtones, and also allowing different tunings between uses. In still other alternative embodiments, each of the strings can be trimmed to the appropriate length for the desired tone. Other means for setting the pitch of each string will be apparent to those skilled in the art. Strings used with instruments such as mandolins, lutes, banjos and the like, and also strings used with instruments such as sitars which produce tones separated by intervals that differ from the intervals characteristic of guitars and related instruments, will require different numbers of frets positioned at different locations on the baseboard in embodiments using baseboards, and/or strings having different lengths. All such alternative sets of strings and frets are considered to be encompassed by the present invention.

Corresponding to each string 12 of the inventive instrument is a plucker 26. Each plucker, upon activation, plucks the string with which it is associated to produce a musical tone. In the embodiment shown in FIGS. 3A–F, plucker 26 includes a plectrum 28 connected to an actuator 30. Plectrum 28 has upper and lower concave surfaces 48 and 50. Actuator 30 has two positions, an upper position and a lower position, between which the actuator moves upon activation. In use, when plucker 26 is activated, actuator 30 moves from one of the two positions to the other position, for example from the lower position to the upper position. In so moving, one of the concave surfaces of plectrum 28 contacts the string 12, and the string slides outward and up (or down, depending on the direction of motion of actuator 30) along the curved surface until the actuator 30 moves the plectrum 28 completely past the string, thus plucking the string and causing it to vibrate to produce the desired tone. Once the actuator 30 has moved from, for example, the first position to the second position, the actuator 30 is then free to move back from the second position to the first position in order to pluck the string 12 again, and to repeat the plucking motion as described further below.

Actuator 30 can be, for example, a solenoid device, or another electromechanical, pneumatic or other device that can move between first and second positions. The actuators are powered by an appropriate power source (not shown). Plectrum 28 can have other geometrical configurations, for example simple cylinders, planes, tines, and the like. Other means for plucking a string can also be employed.

Each of the pluckers 26 plucks its associated string 12 in response to an activating signal from processor 32. Processor 32 in turn receives an input signal from a selector 33 that determines the frequency with which the plucker 26 plucks the string 12, that is, the number of times per second the actuator 30 of the plucker 26 oscillates between its first and second positions, thereby causing plectrum 28 to pluck string 12. That is, the selector 33 provides an input signal to processor 32 which instructs the processor 32 to activate the plucker(s) 26 at a desired frequency.

Figure 4B:
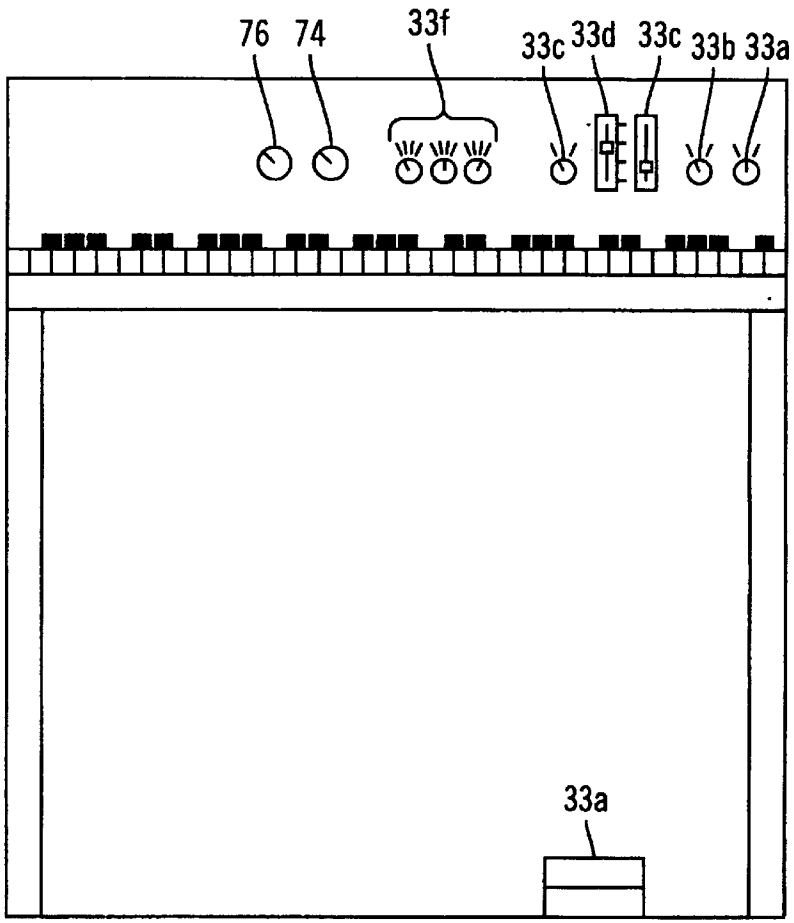
FIGS. 4A–B are illustrations of a keyboard with pedals and switches useful in embodiments of the invention.
Figure 4A:
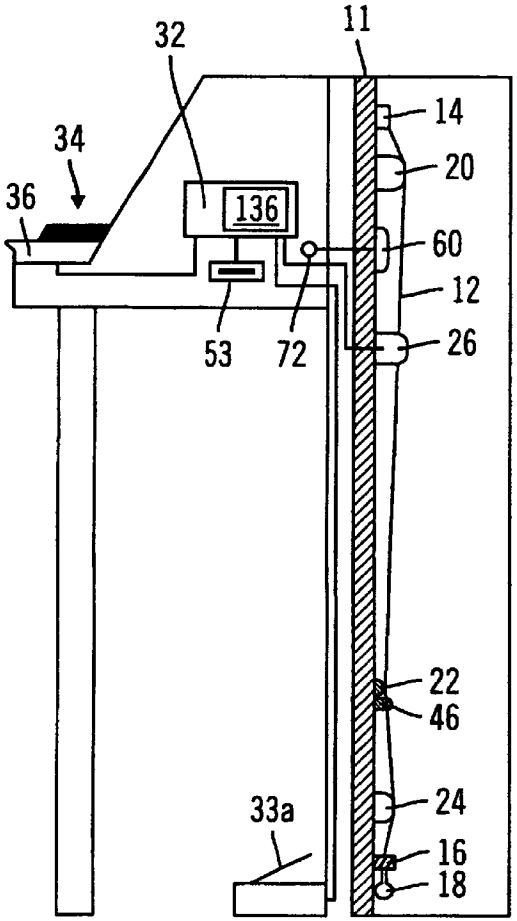

Referring to FIGS. 4A–B, particular selectors 33 that can be used in embodiments of the inventive instrument include a "continuous" selector such as a pedal 33*a*, a dial 33*b* or a slider 33*c*. Such selectors enable the user to provide the processor 32 with a signal that continuously varies between predetermined low and high values depending on the position of the pedal, dial or slider. In turn, the processor 32 sends activating signals to the pluckers at the specified frequency, causing the pluckers to pluck the various strings at the specified desired frequency. In particular embodiments, the plucking frequency is freely and continuously variable; that is, the user is free to continuously vary the plucking frequency by changing the position of the pedal 33*a*, dial 33*b* or slider 33*c* while the processor 32 continues to provide the activating signals to the pluckers 26. In specific embodiments, the chosen selector has a low position (off, or default) that corresponds to a single pluck of the string(s), and a high position that corresponds to a desired maximum frequency such as 10, 20, 32, etc., plucks per second. Thus, by moving the pedal 33*a*, dial 33*b* or slider 33*c* randomly between positions, the user directs the processor 32 to activate the pluckers 26 at a frequency that depends on the instantaneous position of the selector.

Alternative embodiments employ a "discrete" selector 33*d* having a plurality of positions corresponding to distinct frequencies, for example, a single pluck, 2, 4, 8, 16 plucks per second, and so on. The user can manually set such an alternative selector at the desired frequency, and the processor 32 in turn sends the activating signal to the pluckers at the frequency so specified.

In particular embodiments, the inventive instrument includes means by which a user can directly cause activation of the pluckers. Examples of such means include, in particular embodiments, a keyboard 34 that includes a plurality of keys 36 each of which is in communication with processor(s) 32. In specific embodiments that are tuned to produce chromatic scales, the keyboard is a conventional piano keyboard including a plurality of white and black keys. Thus, when electric bass guitar and electric guitar strings are used as described above, particular embodiments of the keyboard will include fifty-nine white and black keys that together span the interval from the open electric bass guitar E string to the twenty-second fret of the second electric guitar E string. As shown in FIG. 1, each key 36 of the keyboard 34 is associated with one plucker 26 and its corresponding string 12 via processor 32.

In operation, a user depresses a key 36 of keyboard 34. Depression of key 36 causes a signal to be transmitted to processor 32, which in turn activates plucker 26. At the same time, processor 32 determines the frequency at which the string is plucked based on input received from selector 33. For example, when the position of selector 33 corresponds to a single pluck, processor 32 provides an activating signal to plucker 26 that causes plucker 26 to pluck its associated string only once. When the position of selector 33 corresponds to a plurality of plucks at a particular frequency, for example four plucks per second, processor 32 provides an activating signal to plucker 26 that causes the plucker to pluck the string at the frequency of four plucks per second. This signal is provided by processor 32 only until the same key 36 is pressed again, thus providing another signal to processor 32. At that point, processor 32 provides an activating signal to plucker 26 that causes the plucker to pluck the string at the frequency that is specified by the position of the selector 33 at the time the key 36 is depressed.

When a single processor 32 is employed, the processor accepts inputs from each key 36 and provides an activating signal to the plucker 26 that corresponds to that key. Alternatively, when a plurality of processors 32 are employed, each processor activates one or more pluckers in response to signals received from an appropriate subset of the keys 36. In particular, when one processor 32 is employed for each string 12, each processor activates its corresponding plucker in response to a signal received from the corresponding key 36.

Alternative embodiments enable a plurality of pluckers, for example two pluckers, to be activated by depression of a single key 36. In more specific embodiments, two pluckers 26 corresponding to strings that produce musical tones that are separated by a predetermined interval are activated when one key 36 is depressed. Particular embodiments of such an instrument activate two pluckers 26 corresponding to strings that are separated by an octave when one key 36 is depressed. Such embodiments may be denoted as including "twelve-string modes", in reference to twelve-string guitars. Different intervals can also be specified, for example, a fifth. The intervals can be the same for each key, or can be different for some or all of the keys. In the latter case, for example, keys corresponding to electric bass guitar strings can activate pluckers corresponding to strings separated by an octave, while keys corresponding to electric guitar strings can activate pluckers corresponding to strings separated by a fifth.

In very specific embodiments, the instrument includes means, such as a switch 33*e*, for enabling the "twelve-string" mode. In such embodiments, when the switch is in the "off" position, each key activates a single plucker, while when the switch is in the "on" position, each key activates two pluckers. Furthermore, such embodiments can include means by which the user specifies the interval between the strings corresponding to the two pluckers. For example, another switch 33*f* can be included which causes a signal to be provided to the processor 32 to set the interval between the two strings activated by the two pluckers at an octave, a fifth, a fourth, etc. A plurality of switches 33*f* that allow specification of different intervals for different subsets of keys can also be provided in alternative embodiments. For example, bass guitar (or bass clef) notes can be separated by an octave while guitar (or treble clef) notes can be separated by a fifth.

Additional alternative embodiments can activate three or more pluckers corresponding to strings separated by specified intervals.

Figure 5B:
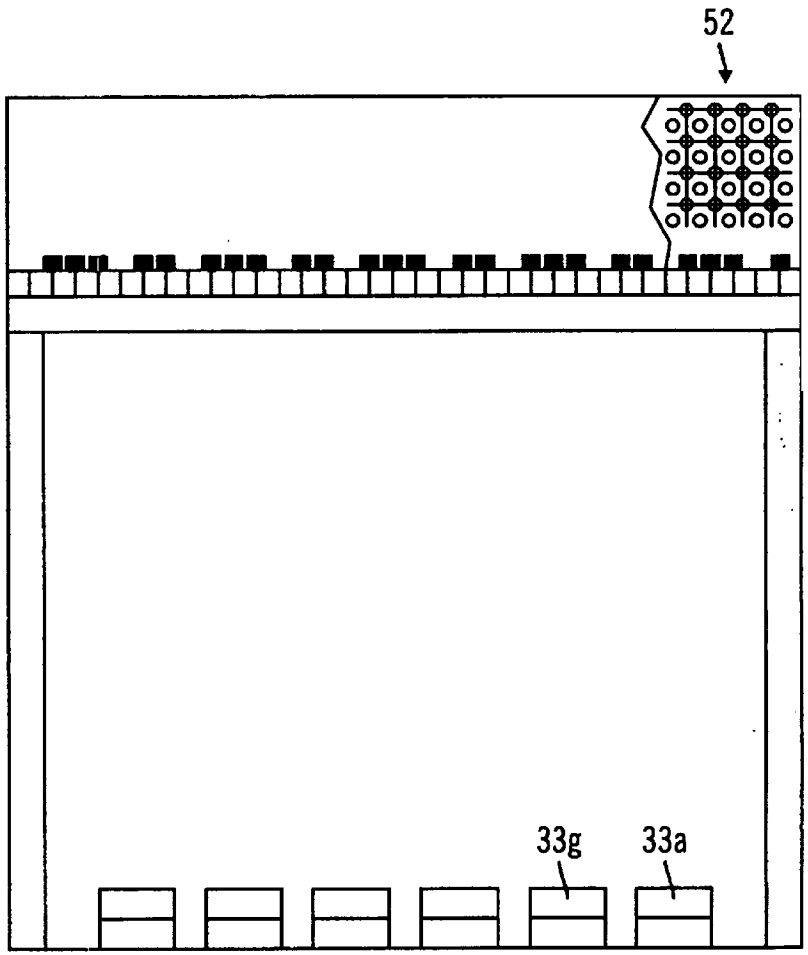
FIGS. 5A–B are illustrations of a portion of a keyboard together and a bank of soft keys useful in alternative embodiments of the invention.
Figure 5A:
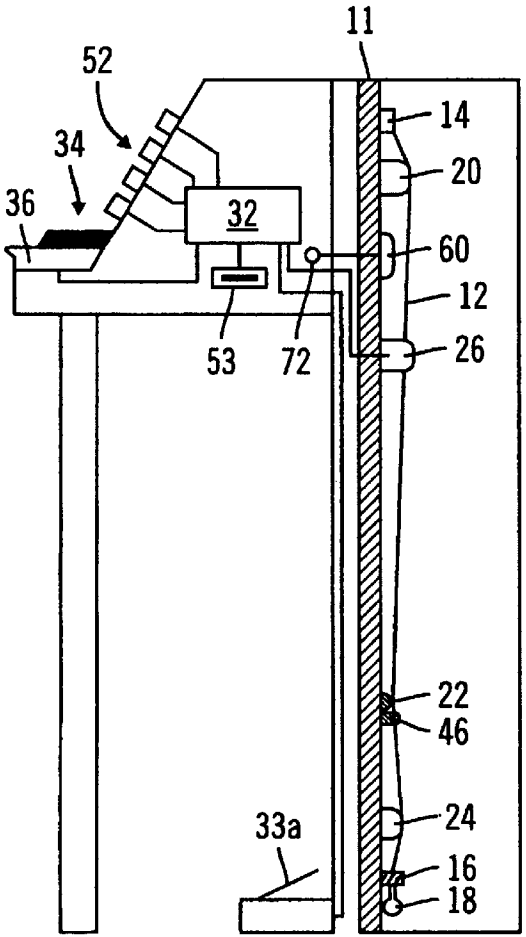

A further development of the foregoing embodiments provides a second plurality of keys 52, each of which simultaneously activates a plurality of pluckers 26. These keys, which can be denoted "soft" keys, are useful in more specific embodiments to play one or more chords based on a key 36 of keyboard 34. For example, with reference to FIGS. 5A–B, each key 36 of keyboard 34 is associated with a plurality of soft keys 52. Each soft key 52 provides a signal to processor 32 to activate pluckers 26 that correspond to a different plurality of strings 12. In this way, for example, one or more chords, comprised of a plurality of notes produced by plucking the respective plurality of strings, can be produced. Chords can be strummed, for example by activating a pedal 33*g* or other controller as described herein.

Figure 6:
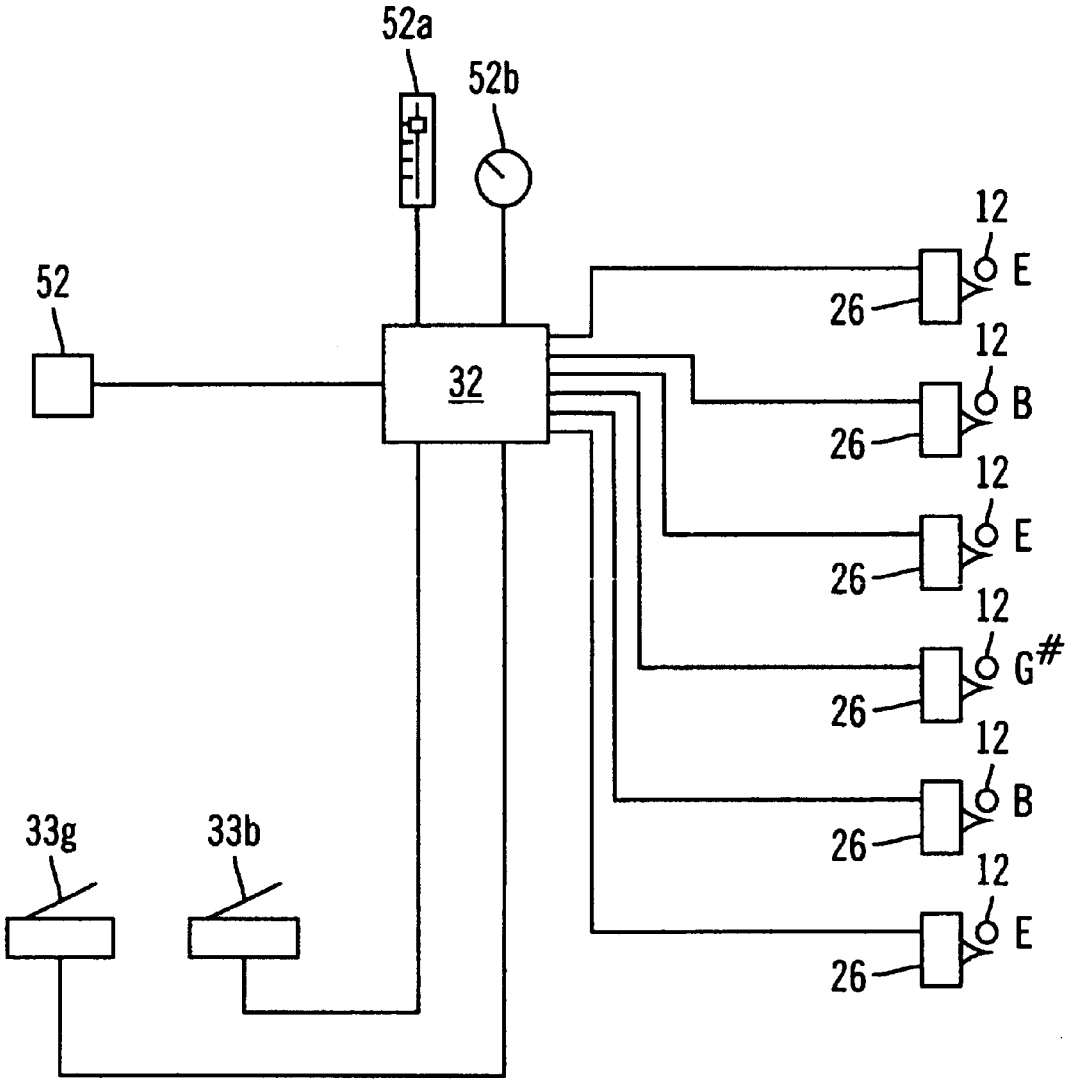
FIG. 6 is a detailed schematic diagram of a soft key and a plurality of strings activated by the soft key, together with selectors.

In an exemplary embodiment as illustrated in FIG. 6, corresponding to a key 36 that produces the note E are a plurality of soft keys 52 that, when depressed, provide a signal to processor 32 that causes the activation of a corresponding plurality of sets of pluckers 26, resulting in production of chords having E as the root note. Thus, one soft key 52 can cause the activation of pluckers that pluck strings corresponding to the notes E, B, E, G#, B and E to produce an E major chord (note that this is a "doubled" chord; alternative soft keys 52 can cause activation, for example, only of the three note triad E, G# and B). Another soft key 52 similarly can produce the notes E, B, D, G#, B and E to produce an E seventh chord, while a third soft key 52 can produce the notes E, B, E, G, B and E to produce an E minor chord. Similarly, any number of chords having as the root note any of the keys 36 of keyboard 34 can be produced. Such embodiments enable the user, for example, to play guitar chords with the right hand while playing single bass notes with the left hand, bass chords with the left hand while playing guitar notes with the right hand, both bass and guitar notes, or both bass and guitar chords. Simultaneously, the user can specify the plucking frequencies of the various notes and chords as described above.

In specific embodiments, the inventive instrument further includes means for specifying which particular combination of pluckers 26 is activated by depression of each soft key 52. Useful means include a disk drive 53 for receiving a floppy disk having encoded therein programmed instructions to the processor 32; an integral keyboard and video monitor by which a user can manually input the necessary instructions to processor 32; and the like.

According to a further development of the foregoing embodiments, the plucking frequency of each plucker 26 activated by one or more of the soft keys 52 is independently selectable and controllable by the user. For example, when soft key 52 activates the three-note triad E, G# and B and the selector is set to a plucking frequency of four plucks per second, plucker 26 associated with the string producing the note E can be provided with instructions by processor 32 to pluck the string at a frequency of four plucks per second, while the pluckers associated with the remaining two strings can be activated to pluck their respective strings only a single time. Alternatively, two of the strings can be plucked at the specified plucking frequency, while the remaining string is plucked only a single time. Such embodiments can be denoted "partial strumming" embodiments.

According to still another particular embodiment, two or more strings plucked as a result of depressing a soft key 52 can be plucked at different frequencies. Again with respect to the foregoing three-note triad, the string producing the note E can be plucked at a frequency of four plucks per second, while the string producing the note G# can be plucked at a frequency of six plucks per second. The third string can be plucked at a frequency of ten plucks per second, or alternatively, plucked only a single time. Any combination of strings and plucking frequencies can be obtained in this manner. Such embodiments can be denoted "polyrhythmic" embodiments.

In particular embodiments, separate selectors (for example, sliders 52*a* or dials 52*b*) are employed to specify the plucking frequency of each note of the chord produced by the soft keys. Alternatively, the particular plucking frequencies can be supplied to processor 32 by various means as discussed previously (i.e., via a floppy disk). Partial strumming can be effected by means of a separate pedal 33*h* or by other means as described herein.

Figure 7A:
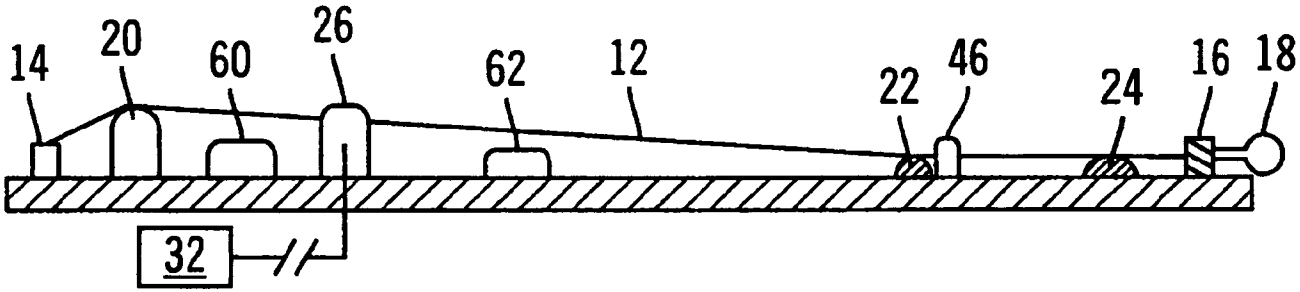
FIGS. 7A–B are side views of embodiments including a plurality of pickups associated with each string.
Figure 7B:
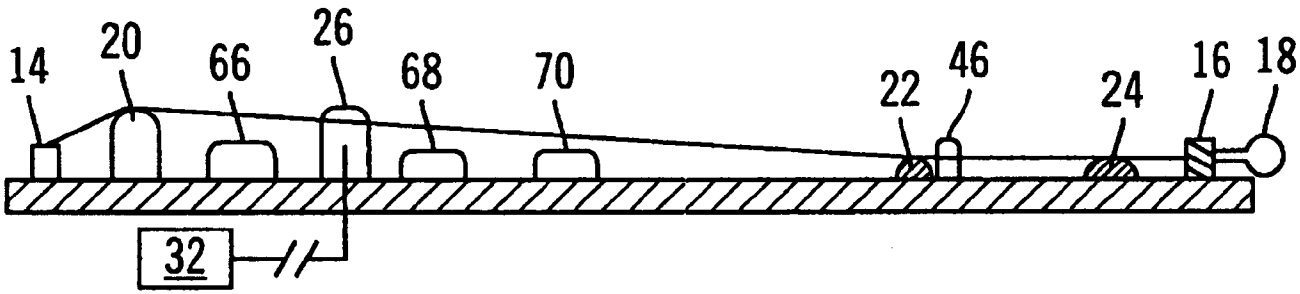

Various embodiments described herein employ metal strings, such as electric bass guitar and/or electric guitar strings. These embodiments preferably also include a plurality of pick-ups 60. In specific embodiments, each of the plurality of strings 12 is associated with at least one of the plurality of pick-ups 60, and each of the pick-ups is responsive to the vibration of at least one of the strings. More specifically, each string 12 is associated with two pick-ups, a front pick-up 62 and a back pick-up 64 (see FIG. 7A). In further alternative embodiments (see FIG. 7B), each string 12 is associated with three pick-ups, a bridge pick-up 66, a middle pick-up 68 and a neck pick-up 70. Embodiments employing pick-ups preferably also include means for electrical communication between the pick-ups and an external amplifier, for example a jack 72, or in another alternative, incorporate an amplifier in electrical communication with the pick-ups.

Amplified embodiments of the inventive instrument, in specific embodiments, further include means 74 for selectively specifying the volume of the tone produced by at least one plucked string. Additional particular embodiments include means 76 for producing at least one sound effect, such as fuzz, wah-wah, reverb or damping. Such means can be similar, for example, to those used in conjunction with conventional electric guitars, and can be a switch, a pedal, etc.

Figure 8:
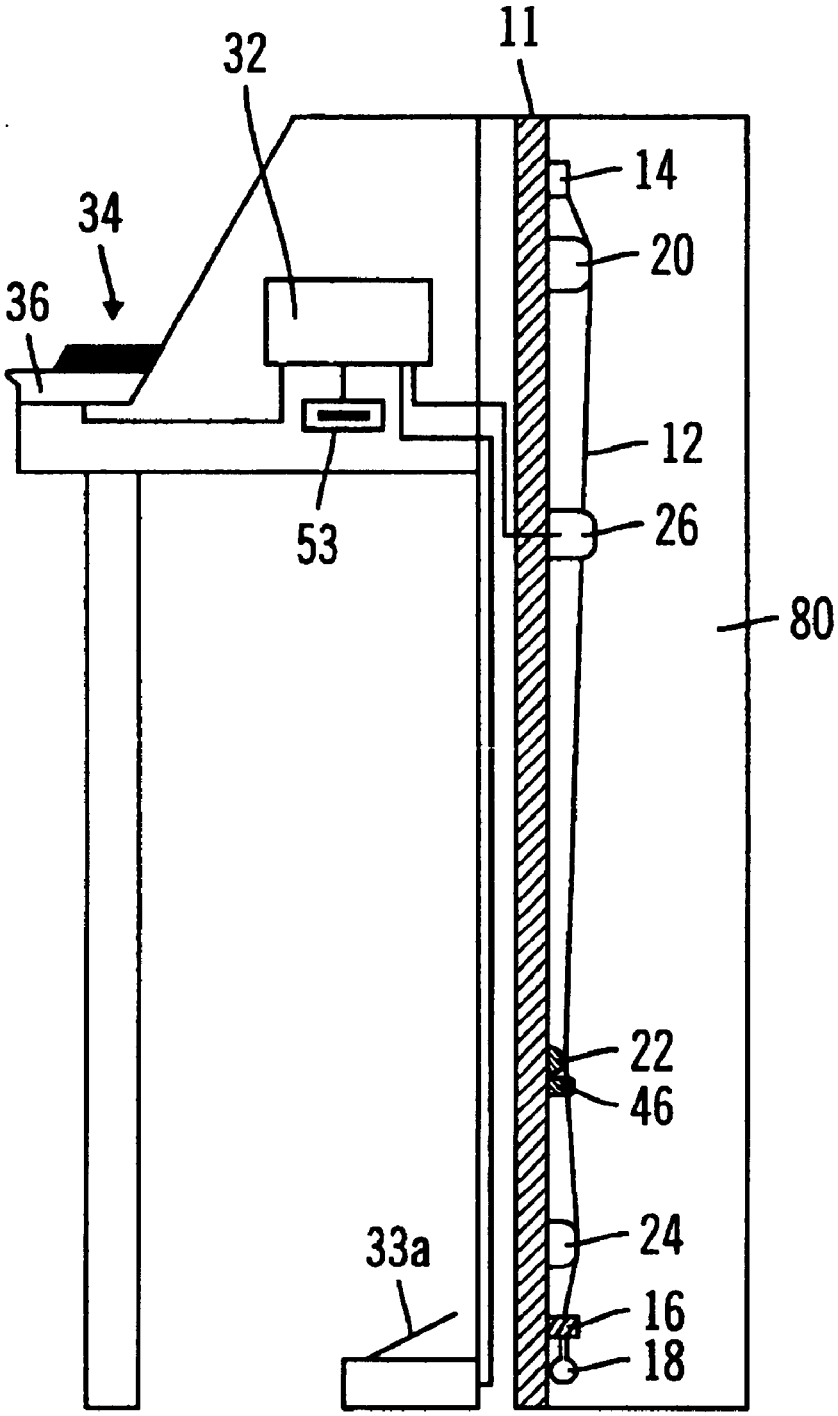
FIG. 8 is a side view of an acoustic embodiment including a sound box.

Other embodiments employing metallic or non-metallic strings do not require amplification. Such embodiments include a sound box 80 within which the plurality of strings 12 are disposed. See FIG. 8.

Figure 9:
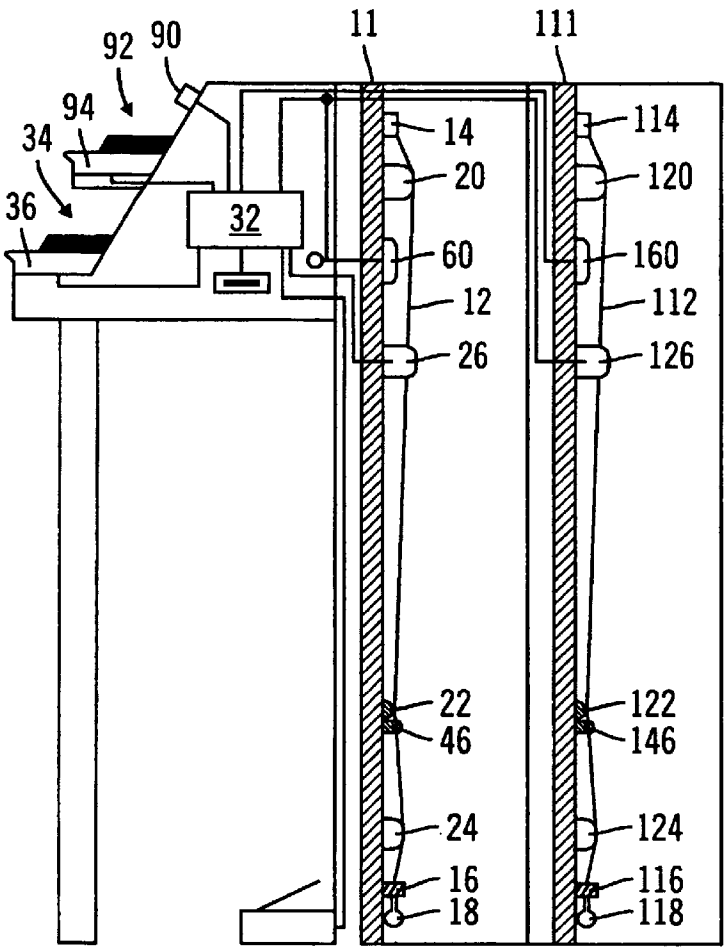
FIG. 9 is an illustration of an alternative embodiment including two sets of strings and pluckers used with dual keyboards.

The foregoing embodiments employ a plurality of strings that are tuned in one ascending sequence. Other embodiments (see, e.g., FIG. 9) include a second baseboard 111, plurality of strings 112, tail piece 114, string posts 116, nuts 118, bridge(s) 120, frets 122, nut(s) 124, pluckers 126, clips 146 and pickups 160. Second control means for selectably controlling the frequency at which the second plurality of pluckers pluck their associated strings can also be included. More specific embodiments also include means for activating the second plurality of pluckers. Some embodiments employ the same means used to activate the first plurality of pluckers, and include a switch 90 which allows the user to specify which set of pluckers is activated. Other embodiments include separate second means, such as a second keyboard 92, with a second plurality of keys 94. These embodiments permit the user to play notes from both sets of strings simultaneously if desired. Such "combination" embodiments can employ two identical pluralities of strings, or two pluralities of strings of different material composition, tuning, etc.

Figure 10:
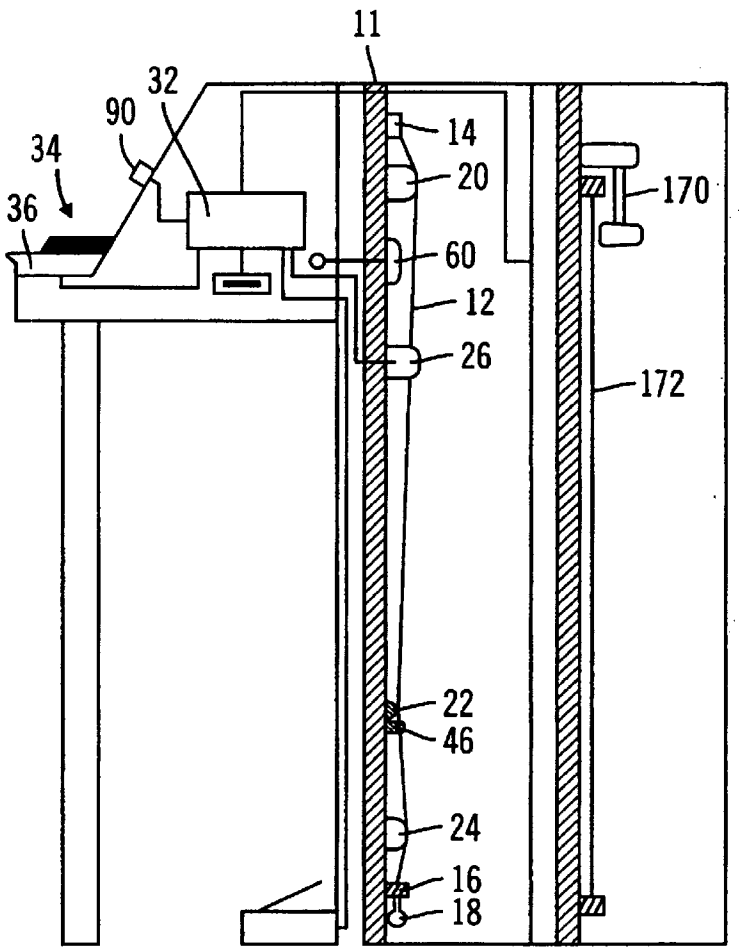
FIG. 10 is an illustration of an alternative embodiment including a first set of plucked strings, a second set of strings and an associated set of hammers for striking the strings, and a single keyboard.

Further developments of the "combination" embodiments (see, e.g., FIG. 10) include a second plurality of strings 172, but rather than a corresponding second plurality of pluckers, include a plurality of hammers 170 and associated means for activating the hammers (such as electromechanical means, pneumatic means, etc). These embodiments allow the user to achieve a combined harpsichord/piano effect if desired, as well as allowing alternation between the two different sets of strings.

Figure 11:
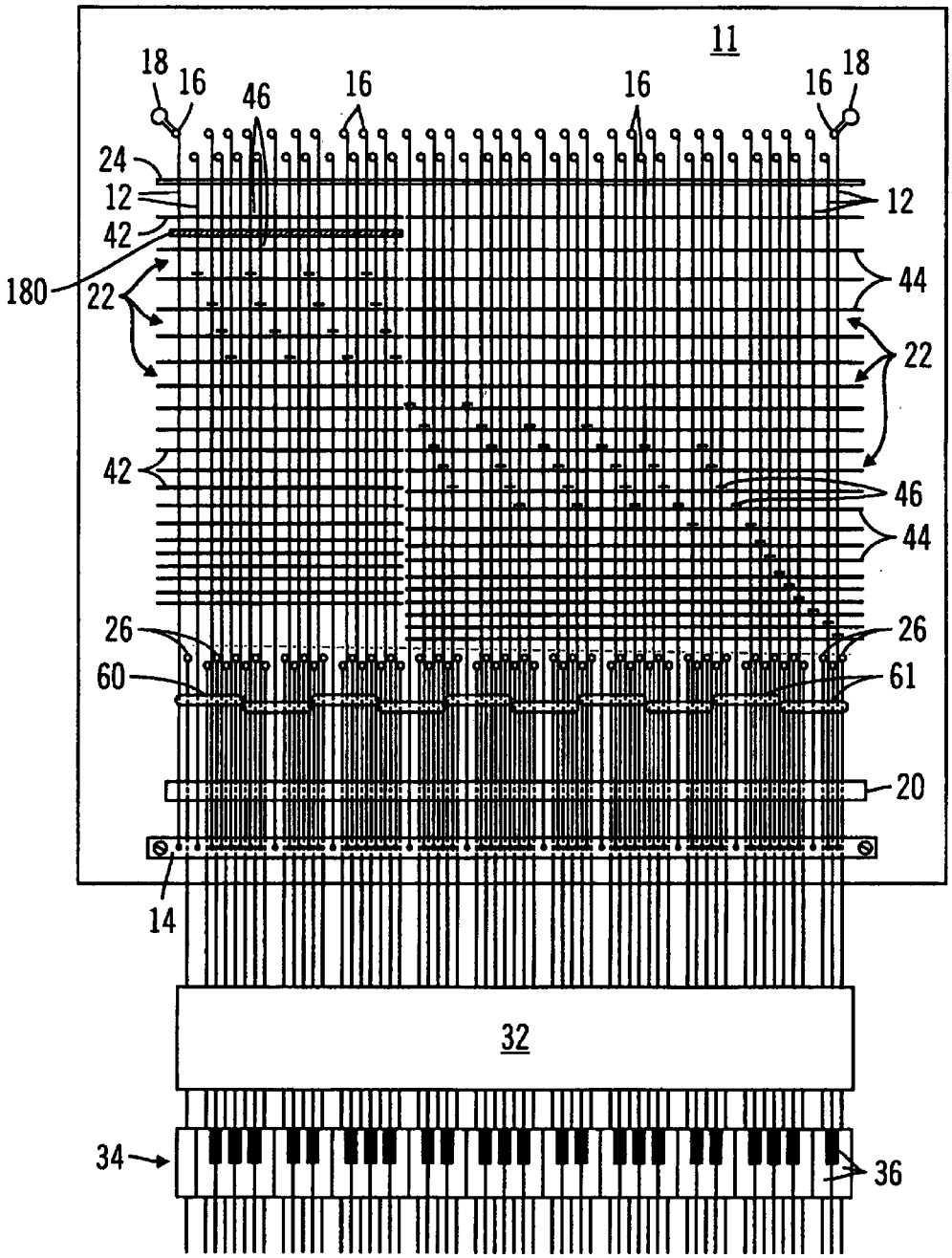
FIG. 11 is an illustration of a capo bar employed with the embodiment of FIG. 1, and FIGS. 12A–B are a side view and detail of a vibrato actuator employed with alternative embodiments of the invention.

Additional embodiments of the inventive instrument that employ frets and a baseboard further include a capo bar 180 that is adapted to extend across at least a portion of the plurality of strings 12. Use of the capo bar allows the user to change the key in which at least a portion of the strings 12 are tuned, in a manner similar to the use of a capo with a conventional guitar. See FIG. 11.

Figure 12A:
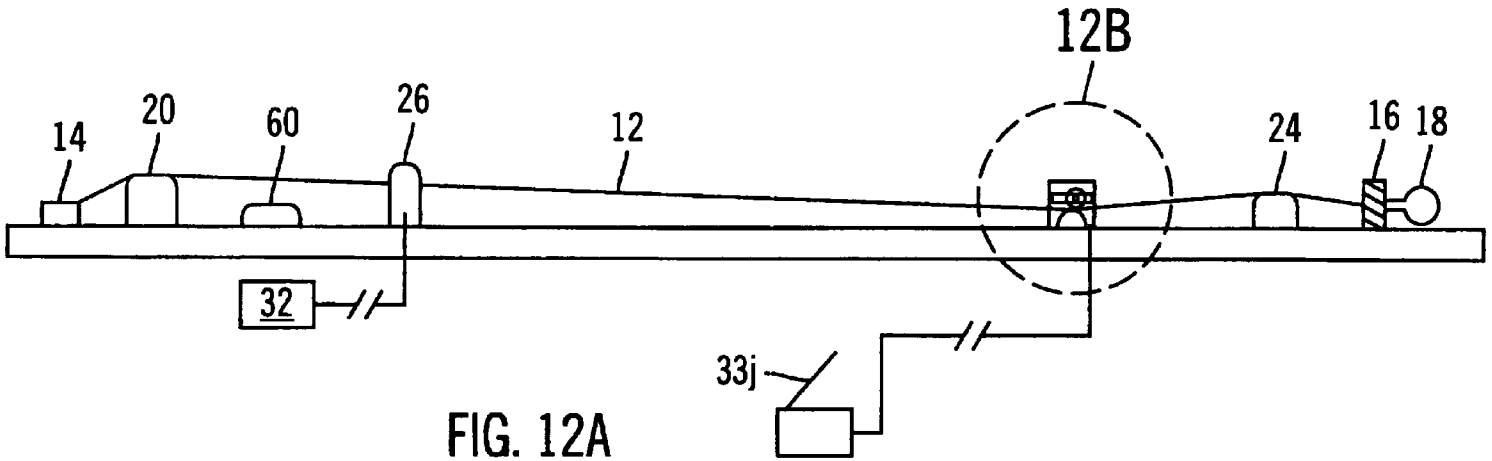
Figure 12B:
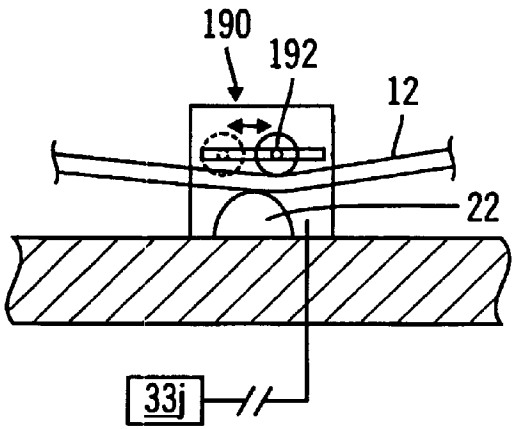

Further embodiments of the inventive instrument include a vibrato actuator 190 (see FIGS. 12A–B). Vibrato actuator 190 includes a horizontally reciprocating element 192 which is, for example, electrically, mechanically or pneumatically driven and which contacts string 12 at fret 22. As a result of the reciprocating motion of element 192, the effective length of string 22 is increased or decreased by a small amount, resulting in slight variations in the pitch of the note after string 12 is plucked. The frequency of reciprocation of element 192 can be controlled in a manner similar to that described above, such as via a pedal 33*j*, as will be obvious to those skilled in the art.

The foregoing embodiments are all useful by a musician in live performance or in a studio. Alternative embodiments of the inventive instrument include programmable means 130 for sequentially activating a plurality of the pluckers 26. Such means can be included in processor 32, for example, or can include a separate processor, as well as a disk drive for receiving a floppy disk that contains an appropriate program to be read into the processor(s), or a keyboard and video display to allow direct input of the desired programming.

What is claimed is:

1. A musical instrument comprising:

a plurality of strings tuned in an ascending sequence, a plurality of pluckers, each of said pluckers being associated with a different one of said plurality of strings and being adapted to pluck said string at a range of plucking frequencies, activating means for activating each of said plurality of pluckers, said activating means comprising a plurality of keys, and control means for selectably controlling the plucking frequency with which said pluckers pluck said strings.

2. The instrument of claim 1 wherein said sequence is a chromatic sequence.

3. The instrument of claim 1 wherein said plurality of strings comprise metal strings.

4. The instrument of claim 3 wherein said plurality of strings comprise a first plurality of electric bass guitar strings and a second plurality of electric guitar strings.

5. The instrument of claim 4 wherein said first plurality of electric bass guitar strings comprises ii) at least one electric bass guitar string having an open-string tuning of E, ii) at least one electric bass guitar string having an open-string tuning of A, iii) at least one electric bass guitar string having an open-string tuning of D, and iv) at least one electric bass guitar string having an open-string tuning of G, and wherein said second plurality of electric guitar strings comprises v) at least one electric guitar string having an open-string tuning of E, vi) at least one electric guitar string having an open-string tuning of A, vii) at least one electric guitar string having an open-string tuning of D, viii) at least one electric guitar string having an open-string tuning of G, ix) at least one electric guitar string having an open-string tuning of B, and x) at least one electric guitar string having an open-string tuning of E, the octaves of the open-string tunings of said electric guitar strings v) and x) being different.

6. The instrument of claim 5 further comprising a baseboard having a first plurality of frets corresponding to the frets of an electric base guitar and a second plurality of frets corresponding to the frets of an electric guitar.

7. The instrument of claim 6 wherein the pitch of each of said plurality of electric bass guitar strings is set by contacting said string with a corresponding fret of said first plurality of frets and wherein the pitch of each of said plurality of electric guitar strings is set by contacting said string with a corresponding fret of said second plurality of frets.

8. The instrument of claim 7 wherein said chromatic sequence spans the interval between the open E string of an electric bass guitar and the twenty-second fret of the second E string of an electric guitar.

9. The instrument of claim 1 wherein each of said pluckers comprises a actuator and a plectrum which is activated by said actuator and which plucks said string associated with said plucker.

10. The instrument of claim 1 wherein said control means comprises a first processor that provides an activating signal to said pluckers and a selector having a plurality of positions each corresponding to a different plucking frequency.

11. The instrument of claim 10 wherein said selector is selected from the group consisting of a pedal, a dial, a slider and a switch having a plurality of discrete positions.

12. The instrument of claim 1 wherein said first processor of said control means provides an output that is specified by the position of said selector and that causes said plucker to pluck its associated string at a frequency specified at least in part by said position of said selector when said plucker is activated.

13. The instrument of claim 12 wherein said first processor further includes means for enabling a user to specify the plucking frequency corresponding to one or more positions of said selector.

14. The instrument of claim 1 further comprising a sounding box within which said plurality of strings is mounted.

15. The instrument of claim 3 further comprising a plurality of pick-ups, wherein each of said plurality of strings is associated with at least one of said plurality of pick-ups and each of said plurality of pick-ups is responsive to at least one of said plurality of strings.

16. The instrument of claim 15 further comprising means for electrical communication between said plurality of pick-ups and an external amplifier.

17. The instrument of claim 15 further comprising an amplifier in electrical communication with said plurality of pick-ups.

18. The instrument of claim 1 wherein each of said plurality of pluckers is activated by at least one of said keys.

19. The instrument of claim 1 wherein said plurality of keys comprises a first plurality of keys arranged in a keyboard, each of said first plurality of keys activating a plucker corresponding to one of said plurality of strings.

20. The instrument of claim 19 wherein at least a portion of said first plurality of keys activates two pluckers, said pluckers corresponding to strings differing in pitch by a predetermined tonic interval.

21. The instrument of claim 20 further comprising means for selectively specifying said predetermined tonic interval.

22. The instrument of claim 1 wherein said plurality of keys comprises a second plurality of keys each of which simultaneously activates a plurality of pluckers.

23. The instrument of claim 22 further comprising means for selectively controlling the frequency at which each of said plurality of simultaneously activated pluckers plucks said string associated therewith.

24. The instrument of claim 1 further comprising:

a second plurality of strings tuned in an ascending sequence, a second plurality of pluckers, each of said pluckers being associated with a different one of said second plurality of strings and being adapted to pluck said string at a range of frequencies, and control means for selectably controlling the frequency with which said second pluckers pluck said second strings.

25. The instrument of claim 24 wherein said second plurality of strings comprise strings formed from materials different from the materials used informing the corresponding strings of said first plurality of strings.

26. The instrument of claim 1 further comprising:

a second plurality of strings tuned in an ascending sequence, a plurality of hammers, each of said hammers being associated with a different one of said second plurality of strings, and means for activating each of said plurality of hammers to strike said string of said second plurality of strings associated therewith.

27. The instrument of claim 15 further comprising means for producing at least one sound effect selected from the group consisting of reverb, fuzz, wah-wah and damping.

28. The instrument of claim 15 further comprising means for selectively specifying the volume of the tone produced by at least one plucked string.

29. The instrument of claim 1 further comprising a capo bar adapted to extend across at least a portion of said plurality of strings.

30. The instrument of claim 1 further comprising programmable means for sequentially activating a plurality of said pluckers.

31. A musical instrument comprising:

a plurality of strings tuned in a chromatic sequence, a plurality of pluckers, each of said pluckers being associated with a different one of said plurality of strings and being adapted to pluck said string at a range of plucking frequencies, activating means for activating each of said plurality of pluckers, said activating means comprising a plurality of keys, and control means for selectably controlling the plucking frequency with which said pluckers pluck said strings upon activation of said pluckers.

32. The instrument of claim 31 further comprising a baseboard comprising a plurality of frets.

33. The instrument of claim 32 herein the pitch of each of said plurality of strings is set by contacting said string with a corresponding fret of said plurality of frets.

* * * * *